US008922434B2

(12) United States Patent
Prat et al.

(10) Patent No.: US 8,922,434 B2
(45) Date of Patent: Dec. 30, 2014

(54) FLAT SCREEN WITH INTEGRATED ANTENNA

(75) Inventors: Christophe Prat, Coueron (FR); Lionel Rudant, Grenoble (FR)

(73) Assignee: Commissariat a l'Energie Atomique et aux Energies Alternatives, Paris (FR)

( * ) Notice: Subject to any disclaimer, the term of this patent is extended or adjusted under 35 U.S.C. 154(b) by 695 days.

(21) Appl. No.: 13/143,589

(22) PCT Filed: Dec. 18, 2009

(86) PCT No.: PCT/FR2009/001461

§ 371 (c)(1),
(2), (4) Date: Oct. 6, 2011

(87) PCT Pub. No.: WO2010/079268

PCT Pub. Date: Jul. 15, 2010

(65) Prior Publication Data

US 2012/0019419 A1 Jan. 26, 2012

(30) Foreign Application Priority Data

Jan. 7, 2009 (FR) ..... 09 00036

(51) Int. Cl.

| | |
|---|---|
| ***H01Q 5/00*** | (2006.01) |
| ***H01Q 13/10*** | (2006.01) |
| ***H01Q 1/22*** | (2006.01) |
| ***H01Q 1/44*** | (2006.01) |

(52) U.S. Cl.

CPC ..... *H01Q 13/106* (2013.01); *H01Q 1/2266* (2013.01); *H01Q 1/44* (2013.01)

USPC ..... 343/700 MS; 343/702

(58) Field of Classification Search

USPC ..... 343/702, 700 MS, 720; 345/173, 107, 345/213, 76

See application file for complete search history.

(56) References Cited

U.S. PATENT DOCUMENTS 6,157,066 A * 12/2000 Kobayashi ..... 257/363
6,339,400 B1 1/2002 Flint et al.

(Continued)

FOREIGN PATENT DOCUMENTS

JP 2005345704 * 2/2005
WO WO 2010/079268 A1 7/2010

OTHER PUBLICATIONS

International Search Report for Application No. PCT/FR2009/001461 dated Feb. 16, 2010.

(Continued)

*Primary Examiner* — Thien M Le
(74) *Attorney, Agent, or Firm* — Alston & Bird LLP

(57) ABSTRACT

The invention relates to a flat screen (E) that comprises an active pixel matrix (M), an electrode that is common to said pixels (C), and a conductive strip (R) preferably in the form of a ring that is connected to said common electrode and at least partially surrounds said active matrix, characterized in that at least one slot (F) defining an antenna is formed in said conducting strip. The invention also relates to a portable apparatus that comprises: such a flat screen (E); an electronic board including a floorplan (PM) parallel to the flat screen and electrically connected to the conductive strip of the same; a means for generating and/or detecting electric radiofrequency signals; and an excitation port (P) for the slot antenna (F) installed in the flat screen, and connected to said means for generating and/or detecting electric radiofrequency signals.

13 Claims, 3 Drawing Sheets

(56) References Cited

U.S. PATENT DOCUMENTS

| | | | | |
|---|---|---|---|---|
| 6,825,811 | B2 | 11/2004 | Iwai et al. | |
| 6,927,668 | B1 * | 8/2005 | Odle et al. | 340/5.53 |
| 6,973,709 | B2 | 12/2005 | Huang | |
| 7,242,353 | B2 | 7/2007 | Hung et al. | |
| 7,336,270 | B2 | 2/2008 | Sato | |
| 2004/0189625 | A1 | 9/2004 | Sato | |
| 2007/0115188 | A1 | 5/2007 | Mizoguchi et al. | |
| 2007/0194994 | A1 | 8/2007 | Waltho | |
| 2010/0182207 | A1 * | 7/2010 | Miyata et al. | 343/702 |

OTHER PUBLICATIONS

Garg, R. et al., *Microstrip Antenna Design Handbook*, Chapter 7, lines 441-481, Artech House, (2001).

* cited by examiner

FLAT SCREEN WITH INTEGRATED ANTENNA

FIELD OF THE INVENTION

The invention relates to a flat screen of the active matrix type that includes an incorporated antenna. The invention also provides a portable electronic appliance such as a mobile telephone, including such a screen.

BACKGROUND OF THE INVENTION

The market for communicating portable or "nomadic" appliances, such as mobile telephones, hand-held computers, etc., is in continuous expansion. Such appliances require antennas in order to be able to connect with communications networks (GMS, UMTS, etc.), in order to use short-range wireless connections (WiFi, Bluetooth, etc.), or in order to make use of satellite positioning and navigation systems (GPS, Galileo, etc.). Sometimes, a single appliance needs to have several antennas, operating at different frequencies.

The use of antennas of traditional type, made as discrete elements and assembled with other components is found to be relatively unsatisfactory in terms of obtaining an appliance that is compact and inexpensive to fabricate. Consequently, various solutions have been developed in order to incorporate antennas in other components.

In modern appliances, the screen—a liquid crystal display (LCD) or having organic light-emitting diodes (OLEDs)—tends to occupy as great an area as possible, generally to the detriment of the keypad, which is sometimes purely and simply omitted in order to be replaced by a touch screen. Proposals have therefore been made to incorporate transmitter and/or receiver antennas in flat screens.

Documents U.S. Pat. No. 6,973,709 and U.S. Pat. No. 6,825,811 describe antennas constituted by patterns of transparent conductive material (indium tin oxide (ITO)) deposited on the screen. These are referred to as printed-on-display (POD) antennas.

Document U.S. Pat. No. 7,242,353 describes an antenna that is incorporated not directly with the screen, but rather with a mechanical support surrounding the screen.

Those solutions are not entirely satisfactory from a cost point of view, since one or more additional technological steps need to be provided in order to fabricate the antenna.

Document U.S. Pat. No. 7,336,270 descries a radiofrequency identity (RFID) antenna made on the substrate of a liquid crystal screen, beside the screen proper, and connected to an electronic chip mounted on the same substrate. That antenna is made together with one of the conductive elements of the screen, without requiring any additional technological step. Nevertheless, provision must be made on the substrate for room to receive the chip and the antenna beside the screen, which goes against requirements for miniaturizing such appliances and which also has a negative influence on cost. Above all, the antenna in question is merely an RFID antenna that operates in the near field.

SUMMARY OF THE INVENTION

The invention seeks to solve the above-mentioned drawbacks of the prior art by providing a screen having an incorporated antenna that can be fabricated with few or no additional technological steps, and that also enables optimum use to be made of the space available. The term "antenna" is used to mean a radiating antenna operating in the far field, for transmission and/or reception.

In accordance with the invention, this object may be achieved by a flat screen having an active matrix of pixels, a common electrode that is common to said pixels, and a conductive strip connected to said common electrode and surrounding said active matrix at least in part, the screen being characterized in that at least one antenna-forming slot is formed in said conductive strip. The conductive strip may form a ring surrounding at least a portion of said active matrix (i.e. the most common circumstance in the prior art), or it may equally well present an open shape, e.g. an L-shape or a U-shape.

The conductive strip, generally ring-shaped, surrounding the active matrix and its common electrode is normally provided in active matrix flat screens for the purpose of achieving a uniform potential for said common electrode (generally the cathode). Consequently, implementing the invention does not increase the dimensions of the device. Furthermore, the slot antenna can be made simultaneously with fabrication of the conductive strip by deposition by using an appropriate photolithographic mask. The extra cost involved is therefore practically zero.

In particular embodiments of the invention:

The antenna may be formed by a slot that opens out to the edge of said strip, by a slot that does not open out, or by an annular slot that surrounds the active matrix of pixels.

Said conductive strip may be made by being deposited on a substrate of the screen and may present thickness lying in the range 50 nanometers (nm) to 2 micrometers (μm), and preferably in the range 100 nm to 1 μm, and/or width lying in the range 50 μm to 10 millimeters (mm), preferably in the range 100 μm to 2 mm. This width may be constant or may vary along the strip. Advantageously, the slot is made in the widest portion of the strip.

Said slot may be dimensioned in such a manner as to be resonant at at least one frequency lying in the range 100 megahertz (MHz) to 10 gigahertz (GHz).

The invention also provides a portable appliance comprising: such a flat screen; an electronic card including a ground plane parallel to said flat screen and electrically connected to the conductive strip thereof; means for generating and/or detecting radiofrequency electric signals; and a port for exciting the slot antenna incorporated in the flat screen, the port being connected to said means for generating and/or detecting radiofrequency electric signals.

Advantageously, the slot antenna may be dimensioned so as to present resonance and so as to be at least approximately impedance-matched with the excitation port at a frequency of the electric signals generated or detected by said means.

BRIEF DESCRIPTION OF THE DRAWINGS

Other characteristics, details, and advantages of the invention appear on reading the following description made with reference to the accompanying drawings given by way of example and in which.

DETAILED DESCRIPTION OF THE INVENTION

Figure 1:
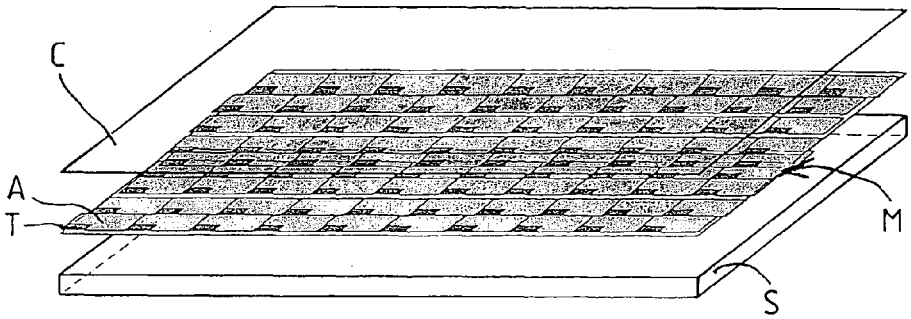
FIG. 1 is an exploded view of a prior art flat screen having organic OLEDs.

FIG. 1 shows that an OLED type active matrix flat screen E generally comprises a transparent substrate S, typically made of glass, having deposited thereon a matrix M of transparent electrodes (anodes) A that are connected individually to electrical power supply lines (not shown) via thin film transistors T. A light-emitting semiconductor polymer layer forming the OLEDs is deposited on the anodes A. An anode A and the corresponding OLED form a pixel, or more precisely a sub-pixel (where a complete pixel is made up of three pixels of different colors: blue, green, and red). A metallic layer C deposited over the polymer layer forms a cathode that is common to all of the pixels.

The common cathode C is of thickness that is very small, of the order of 1 μm, compared with lateral dimensions (width, length) of a few centimeters. In order to ensure that the relatively high resistance that results therefrom nevertheless gives rise to voltage drops from one point to another of the cathode that are negligible, and thus in order to ensure an electric potential that is uniform and does not interfere with proper operation of the matrix of transistors, it is known to provide a thicker ring-shaped conductor strip at the periphery of the cathode and in electrical contact therewith. Such a ring, referenced R in FIGS. 2 and 3*a* to 3*e*, may typically present thickness lying in the range 50 nm to 2 μm, and preferably lying in the range 100 nm to 1 μm, and width lying in the range 50 μm to 10 mm and preferably in the range 100 μm to 2 mm. The conductivity of the ring R is sufficient to maintain a substantially uniform potential and thus to make the potential of the common cathode C uniform. The ring may be made of aluminum or of silver or of copper, or indeed of molybdenum, for example. As mentioned above, the ring R may be replaced by a conductive strip presenting an "open" shape, e.g. a U-shape or an L-shape, that extends over a fraction only of the periphery of the cathode.

Preferably, in order to minimize its dimensions, and as shown in the figure, the ring R does not project beyond the surface of the screen E.

The idea on which the invention is based consists in using a slot or a groove formed in the ring R as an antenna. The principle of the slot antenna is itself known in the prior art: see in particular Chapter 7, lines 441-481 of the work by R. Garg, P. Bhartia, I. Bahl & A. Ittipiboon, "Microstrip antenna design handbook", 2001 Artech House.

Figure 2:
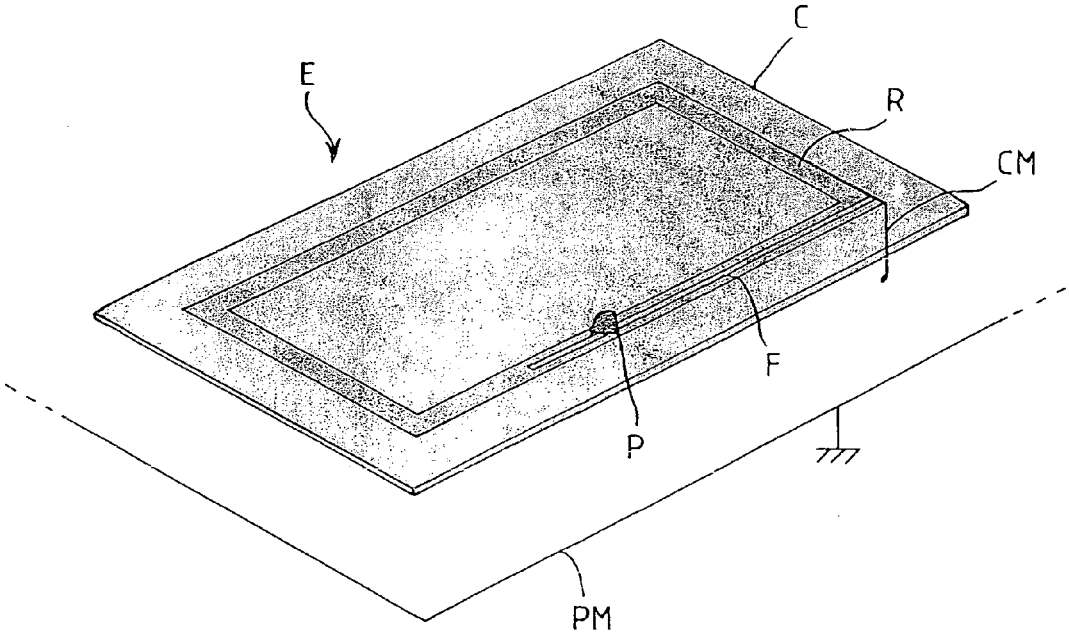
FIG. 2 is a diagrammatic elevation view of a flat screen of the invention in which a slot antenna is incorporated.

FIG. 2 shows an active matrix screen E having a conductor ring R with a slot F formed therein that opens out to an edge of the ring. A port P enables the slot to be excited by a radiofrequency signal, or conversely enables an electrical signal induced in the slot by an external radiofrequency electromagnetic field to be extracted; paragraph 7.3 of the above-mentioned work describes excitation ports for a slot antenna based on the principle of the coplanar waveguide.

The electromagnetic signal injected into the slot F via the port P, or picked up by said slot, does not influence the operation of the transistors of the screen E since its frequency is well above the cutoff frequency of those devices. Typically, wireless communications protocols for nomadic appliances involve using frequencies greater than 500 MHz, and possibly as high as 5 GHz to 6 GHz (for example the GMS standard operates at 900 MHz, the GPS standard at 1.5 GHz, the UMTS standard at 2 GHz, and the WiFi standard at 2.4 GHz and at 5 GHz).

A ground plane PM extends parallel to the screen E at a distance of a few millimeters therefrom: such a ground plane is generally provided in the electronic cards of appliances fitted with a screen of the invention. A connection CM connects the ring R to the ground plane.

Figure 3A:
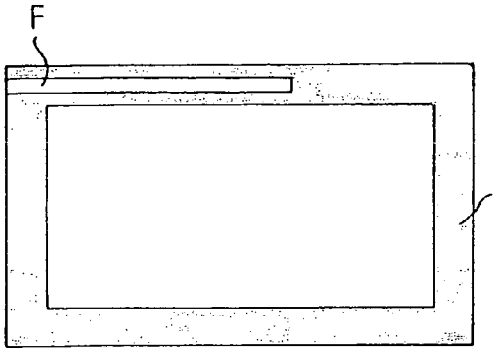
FIGS. 3*a*, 3*b*, 3*c*, 3*d*, and 3*e* show different layouts for a slot antenna suitable for being incorporated in a screen of the FIG. 1 type.
Figure 3B:
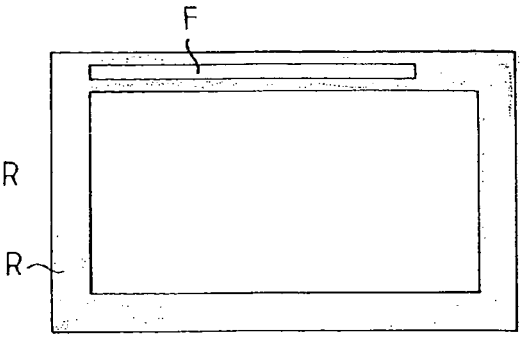
Figure 3C:
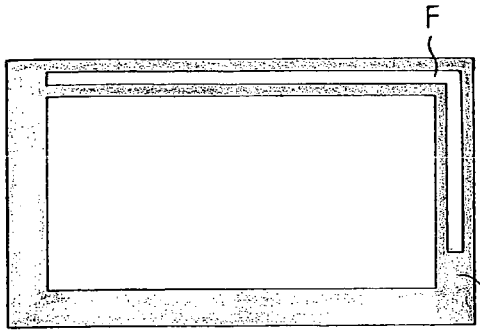
Figure 3D:
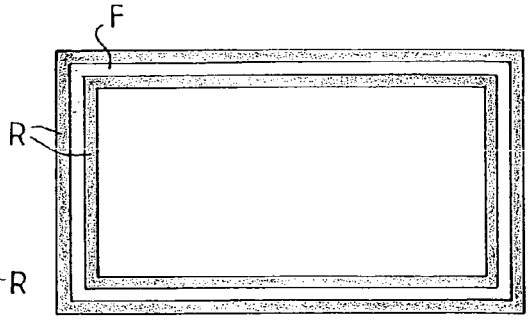
Figure 3E:
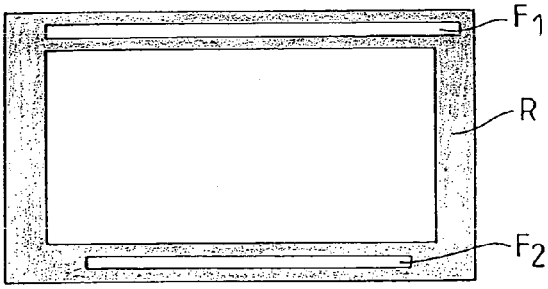

The open slot (making an antenna of the so-called "notch" type) shown in FIGS. 2 and 3*a* constitutes only one possible embodiment of the invention. In a variant, the slot could be non-open and rectilinear (FIG. 3*b*), non-open and L-shaped (FIG. 3*c*), L-shaped and open at one end (not shown), or indeed ring-shaped (FIG. 3*d*). It is also possible to form a plurality of distinct slot-antennas ($F_1$, $F_2$) so as to be able to operate at multiple frequencies, also as to provide antenna-diversity systems (FIG. 3*e*).

In general, the open slot of FIG. 3*a* constitutes the preferred embodiment of the invention because of its small dimensions: this is because its length is only $\lambda/4$ instead of being $\lambda/2$ as applies to a non-open slot, where $\lambda$ is the wavelength associated with the resonant frequency of the slot.

The ring slot of FIG. 3*d* constitutes an embodiment that is relatively constraining since the dimensions of the ring determine the resonant frequency of the antenna. In addition, it is necessary to provide a conductor "bridge" for connecting together the two portions of the ring R that are separated by the slot.

Figure 4A:
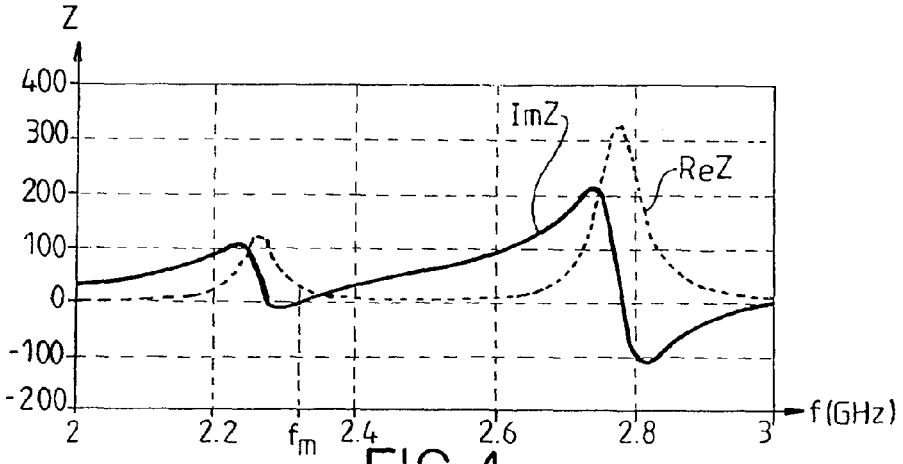
FIGS. 4*a*, 4*b*, and 4*c* are graphs for assessing the performance of an antenna incorporated in a flat screen of the invention.
Figure 4B:
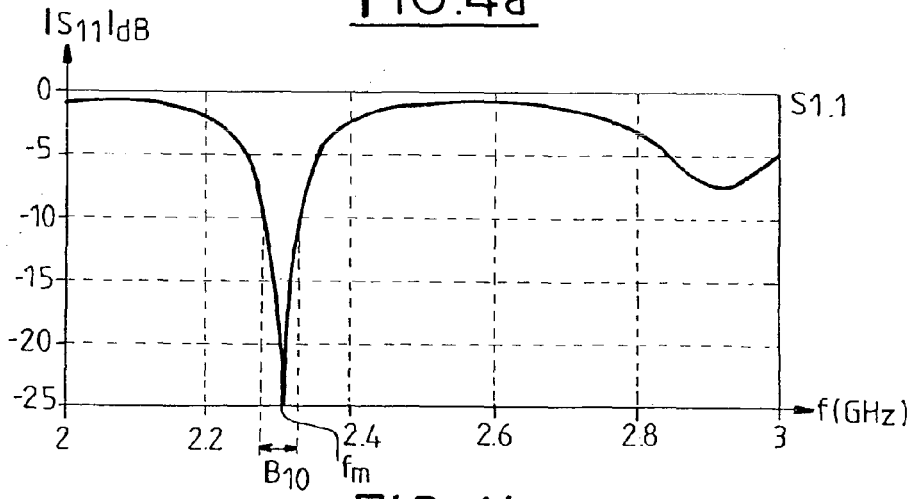
Figure 4C:
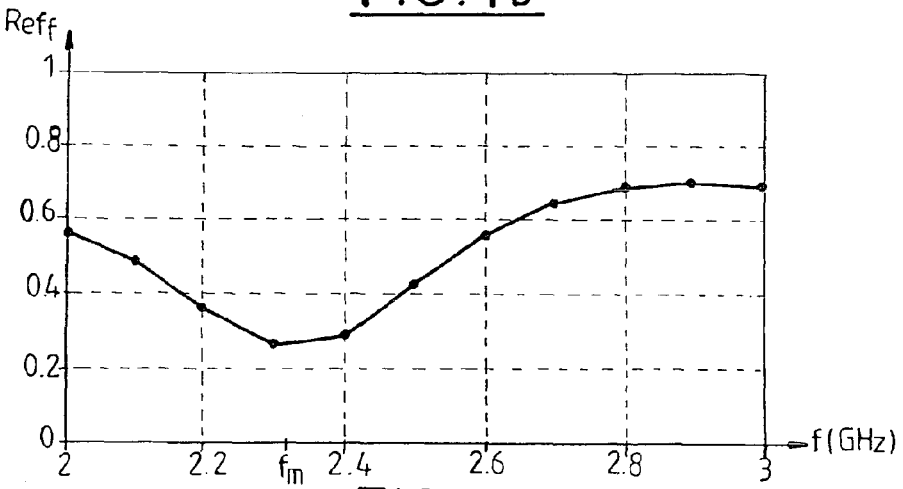

FIGS. 4*a* to 4*c* show the results of simulation based on the device of FIG. 2. The characteristics of the simulated structure are as follows:

Pyrex glass substrate having a thickness of 1 mm with $|\in_r|=4.82$ and $\tan\delta=0.0054$, and of dimensions 30 mm×50 mm;

an aluminum conductor ring having a width of 2 mm, a thickness of 1 μm, and a rectangular shape having dimensions of 22 mm×42 mm;

a ground plane that is assumed to be infinite and that is located at 5 mm from the cathode C;

a cathode C made of aluminum and having a thickness of 1 μm;

a slot that is open into a long side of the ring, of rectangular shape, of width 0.5 mm, and of length 3 cm; and a 50 ohm (Ω) port P.

The graph of FIG. 4*a* shows the impedance Z (curve ReZ=real portion; curve ImZ=imaginary portion) of the slot as a function of frequency f expressed in GHz. Two resonances are observed, one around 2.3 GHz and the other at about 2.75 GHz. The first resonant peak serves to achieve an impedance near-match (at 50Ω) between the slot and the port P at a frequency $f_m \approx 2.3$ GHz. The graph showing the modulus of the parameter $S_{11}$ (voltage reflection coefficient at the inlet), as shown in FIG. 2*b*, confirms this result: it can be seen that $|S_{11}|$ has a minimum value of −25 decibels (dB) and a −10 dB bandwidth $B_{10}$ of about 25 MHz centered around $f_m$.

The value $f_m$ does not depend solely on the layout of the slot F, but also on its environment, and in particular on the dielectric properties of the substrate S and on the distance at which the ground plane PM is situated.

The resistivity of the ring R, and above all the dielectric losses in the glass substrate, limit the radiation efficiency $R_{eff}$ of the antenna, as shown in FIG. 4*c*. Since the structure is not optimized, this efficiency is at a minimum at the frequency $f_m$; nevertheless, even under these conditions, it is comparable with the specifications for most wireless communications applications.

The invention is described above with reference to a particular type of OLED screen, but that does not constitute any kind of limitation. The invention is equally applicable to LCD screens, and also to OLED or LCD screens of other structures, using an opaque structure and a transparent electrode C (which may be a cathode as in the example described, or an anode).

The invention claimed is:

1. A flat screen (E) having an active matrix of pixels (M), a common electrode (C) that is common to said pixels, and a conductive strip (R) electrically connected to said common electrode and surrounding said active matrix at least in part, the screen being characterized in that at least one antenna-forming slot (F) is formed in said conductive strip.

2. A flat screen according to claim 1, wherein said conductive strip forms a ring surrounding at least a portion of said active matrix.

3. A flat screen according to claim 2, wherein said antenna is formed by an annular slot surrounding the active matrix of pixels.

4. A flat screen according to claim 1, wherein said antenna is formed by a slot that does not open out.

5. A flat screen according to claim 1, wherein said conductive strip presents width lying in the range 50 μm to 10 mm.

6. A flat screen according to claim 1, wherein said slot is dimensioned so as to be resonant at least one frequency lying in the range 100 MHz to 10 GHz.

7. A portable appliance comprising:

a flat screen (E) according to claim 1;

an electronic card including a ground plane (PM) parallel to said flat screen and electrically connected to the conductive strip thereof;

means for generating and/or detecting radiofrequency electric signals; and a port (P) for exciting the slot antenna incorporated in the flat screen, the port being connected to said means for generating and/or detecting radiofrequency electric signals.

8. A portable appliance according to claim 7, wherein the slot antenna is dimensioned so as to present resonance and so as to be at least approximately impedance-matched with the excitation port at a frequency ($f_m$) of the electric signals generated or detected by said means.

9. A flat screen according to claim 1, wherein said conductive strip presents width lying in the range 100 μm to 2 mm.

10. A flat screen having an active matrix of pixels, a common electrode that is common to said pixels, and a conductive strip electrically connected to said common electrode and surrounding said active matrix at least in part, wherein at least one antenna-forming slot is formed in said conductive strip, and wherein said antenna is formed by a slot that opens out to an edge of said conductive strip.

11. A flat screen having an active matrix of pixels, a common electrode that is common to said pixels, and a conductive strip electrically connected to said common electrode and surrounding said active matrix at least in part, wherein at least one antenna-forming slot is formed in said conductive strip, and wherein said conductive strip is made by being deposited on a substrate (S) of the screen.

12. A flat screen according to claim 11, wherein said conductive strip presents thickness lying in the range 50 nm to 2 μm.

13. A flat screen according to claim 11, wherein said conductive strip presents thickness lying in the range 100 nm to 1 μm.

* * * * *